US009857715B2

(12) United States Patent
Ron et al.

(10) Patent No.: US 9,857,715 B2
(45) Date of Patent: Jan. 2, 2018

(54) LIQUID ELECTROPHOTOGRAPHIC COMPOSITION

(71) Applicant: Hewlett-Packard Indigo B.V., Amstelveen (NL)

(72) Inventors: Hannoch Ron, Kadima (IL); Inna Tzomik, Modiin (IL)

(73) Assignee: Hewlett-Packard Indigo B.V., Amsteiveen (NL)

( * ) Notice: Subject to any disclaimer, the term of this patent is extended or adjusted under 35 U.S.C. 154(b) by 0 days.

(21) Appl. No.: 15/102,495

(22) PCT Filed: Jan. 24, 2014

(86) PCT No.: PCT/EP2014/051445

§ 371 (c)(1),
(2) Date: Jun. 7, 2016

(87) PCT Pub. No.: WO2015/110173

PCT Pub. Date: Jul. 30, 2015

(65) Prior Publication Data

US 2016/0342103 A1 Nov. 24, 2016

(51) Int. Cl.

| | |
|---|---|
| ***G03G 9/135*** | (2006.01) |
| ***G03G 9/125*** | (2006.01) |
| ***G03G 9/12*** | (2006.01) |
| ***G03G 9/13*** | (2006.01) |
| ***G03G 15/10*** | (2006.01) |

(52) U.S. Cl.
CPC ..... *G03G 9/125* (2013.01); *G03G 9/122* (2013.01); *G03G 9/13* (2013.01); *G03G 15/10* (2013.01)

(58) Field of Classification Search
CPC ..... G03G 9/122
See application file for complete search history.

(56) References Cited

U.S. PATENT DOCUMENTS

| | | | | |
|---|---|---|---|---|
| 5,346,796 | A | 9/1994 | Almog | |
| 6,376,147 | B1 * | 4/2002 | Bonsignore | G03G 9/122 430/114 |
| 6,605,483 | B2 | 8/2003 | Victor et al. | |
| 6,664,017 | B1 * | 12/2003 | Patel | G03G 9/0902 430/10 |
| 6,960,667 | B2 | 11/2005 | Kunimoto et al. | |
| 8,410,689 | B2 | 4/2013 | Ebisawa et al. | |

(Continued)

FOREIGN PATENT DOCUMENTS

| | | |
|---|---|---|
| GB | 1411739 | 10/1975 |
| WO | WO 00/50525 | 8/2000 |

(Continued)

OTHER PUBLICATIONS

International Search Report and Written Opinion for International Application No. PCT/EP2014/051445 dated Jun. 20, 2014, 9 pages.

(Continued)

*Primary Examiner* — Peter Vajda
(74) *Attorney, Agent, or Firm* — HP Inc. Patent Department

(57) ABSTRACT

Liquid electrophotographic compositions, methods of manufacturing liquid electrophotographic compositions, methods of printing using liquid electrophotographic compositions and printed articles are disclosed.

15 Claims, 2 Drawing Sheets

(56) References Cited

U.S. PATENT DOCUMENTS

| | | | | |
|---|---|---|---|---|
| 2006/0017057 | A1 | 1/2006 | Cumpston et al. | |
| 2010/0167198 | A1 | 7/2010 | Park et al. | |
| 2011/0008725 | A9* | 1/2011 | Marko ..... | C09D 11/30 430/114 |

FOREIGN PATENT DOCUMENTS

| | | |
|---|---|---|
| WO | WO 2007/130069 | 11/2007 |
| WO | WO 2009/151446 | 12/2009 |
| WO | WO 2011/110221 | 9/2011 |
| WO | WO 2012/082129 | 6/2012 |
| WO | WO 2013/091667 | 6/2013 |

OTHER PUBLICATIONS

Aman, Zaeem, "Efficiency of Fluorescent Whitening Agents in Pigment Coatings", Master Thesis, Academic Achieve On-line, Sep. 2012, 75 pgs.

* cited by examiner

LIQUID ELECTROPHOTOGRAPHIC COMPOSITION

BACKGROUND

Digital printing involves technologies in which a printed image is created directly from digital data, for example using electronic layout and/or desktop publishing programs. Known methods of digital printing include full-color ink-jet, electrophotographic printing, laser photo printing, and thermal transfer printing methods.

Electrophotographic printing techniques involve the formation of a latent image on a photoconductor surface mounted on an imaging plate. The photoconductor is first sensitized to light, usually by charging with a corona discharge, and then exposed to light projected through a positive film of the document to be reproduced, resulting in dissipation of the charge in the areas exposed to light. The latent image is subsequently developed into a full image by the attraction of oppositely charged toner particles to the charge remaining on the unexposed areas. The developed image is transferred from the photoconductor to a rubber offset blanket, from which it is transferred to a substrate, such as paper, plastic or other suitable material, by heat or pressure or a combination of both to produce the printed final image.

The latent image is developed using either a dry toner (a colorant mixed with a powder carrier) or a liquid ink (a suspension of a colorant in a liquid carrier). The toner or ink generally adheres to the substrate surface with little penetration into the substrate. The quality of the final image is largely related to the size of the particles, with higher resolution provided by smaller particles. Dry toners used in solid electrophotography are fine powders with a relatively narrow particle size distribution that are expelled from fine apertures in an application device. Coloured liquid inks used in liquid electrophotography are generally comprised of pigment- or dye-based thermoplastic resin particles suspended in a non-conducting liquid carrier, generally a saturated hydrocarbon.

Colourless or transparent liquid compositions which do not contain any pigment or dye have also been developed to be used in electrophotographic printing, and can be used to provide a glossy appearance to a printed article.

DETAILED DESCRIPTION

Before the present invention is disclosed and described, it is to be understood that this disclosure is not limited to the particular materials and process steps disclosed herein because such materials and process steps may vary somewhat. It is also to be understood that the terminology used herein is used for the purpose of describing particular examples only. The terms are not intended to be limiting because the scope of the present disclosure is intended to be limited only by the appended claims and equivalents thereof.

It is noted that, as used in this specification and the appended claims, the singular forms "a," "an," and "the" include plural referents unless the context clearly dictates otherwise.

As used herein, "liquid electrophotographic composition" generally refers to a liquid composition having a carrier liquid, a polymer resin and an optical brightening agent suitable for printing in an electrophotographic composition. Accordingly, a liquid electrophotographic composition may further comprise a mixture of a variety of different agents or additives, including without limitation, surfactants, organic solvents and co-solvents, charge control agents, viscosity modifiers, sequestering agents, stabilizing agents, and anti-coagulation agents. Though not part of the liquid electrophotographic composition per se, in addition to the optical brightening agent, the composition may include a dispersant for the optical brightening agent and can further carry solid additives such as additional resins, latexes, UV curable materials, plasticizers, salts, charge control agents, etc.

Unless stated otherwise, "liquid electrophotographic composition" is to be understood to mean a liquid composition which does not contain any pigment and so appears transparent to the naked eye under normal light when applied on a substrate. The liquid electrophotographic composition described herein may be referred to as a non-pigmented liquid electrophotographic composition, or as a transparent liquid electrophotographic composition, which are to be understood as being interchangeable. Similar definitions may be applied to the optical brightening agent.

As used herein, "carrier liquid" or "liquid vehicle" refers to the fluid in which the optical brightening agent and polymer resin of the present disclosure can be dispersed. Such a carrier liquid can be formulated for electrophotographic printing so that the electrophotographic composition has a viscosity and conductivity for such printing.

As used herein, "co-solvent" refers to any solvent, including organic solvents, present in the liquid electrophotographic composition.

As used herein, "optical brightening agent" generally refers to a molecule which absorbs UV light between 380 and 270 nm and emits light at 420 to 500 nm, i.e. a fluorescent molecule. Fluorescent molecules are those which absorb light or other electromagnetic radiation and emit longer wavelength electromagnetic radiation. Such optical brightening agents are known and are used to increase the perception of brightness or whiteness of papers, textiles, plastics and other materials.

As used herein, the fluorescence profile of the optical brightening agent refers to the difference between the fluorescence emission of a substrate and the fluorescence emission of a liquid electrophotographic composition as described herein printed on that same substrate.

As used herein, "substituted" or "derivatized" means that a hydrogen atom of a compound or moiety is replaced by another atom such as a carbon atom or a heteroatom, which is part of a group referred to as a substituent. Substituents include, for example, alkyl, alkoxy, aryl, aryloxy, alkenyl, alkenoxy, alkynyl, alkynoxy, thioalkyl, thioalkenyl, thioalkynyl, thioaryl, sulfonyl, sulfuryl, sulfinyl etc.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, the term "substantially" or "substantial" refers to the complete or nearly complete extent or degree of an action, characteristic, property, state, structure, item, or result.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and sub-ranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

Measurement of coat thickness or coat weight of pigmented electrophotographic inks for quality control and process efficiency purposes is possible based on the color density of the printed ink. However, since transparent electrophotographic compositions are non-pigmented, it is not possible to determine coat thickness or coat weight of these transparent compositions in this manner.

It has been recognised that inclusion of an optical brightening agent into a liquid electrophotographic composition, for example a transparent or non-pigmented liquid electrophotographic composition, allows an in-line determination of thickness or coat weight of the printed composition based on the fluorescence profile of the composition comprising the optical brightening agent.

Thus, the present disclosure is directed to liquid electrophotographic compositions and methods. That being understood, it is noted that when discussing the present compositions and associated methods, each of these discussions can be considered applicable to each of these examples, whether or not they are explicitly discussed in the context of that example. For example, in discussing a carrier liquid for use in a liquid electrophotographic composition, such a carrier liquid is to be understood as being used in a method of making the liquid electrophotographic composition.

The present disclosure provides a liquid electrophotographic composition, comprising a carrier liquid; a polymer resin; and an optical brightening agent. The liquid electrophotographic composition may be a non-pigmented, transparent or colourless liquid electrophotographic composition. The optical brightening agent may be a non-pigmented or colourless optical brightening agent.

Additionally the present disclosure provides a method of manufacturing a liquid electrophotographic composition as described herein, comprising grinding a carrier liquid, a polymer resin and an optical brightening agent to form the liquid electrophotographic composition.

Additionally the present disclosure provides a method of electrophotographic printing, comprising printing the liquid electrophotographic composition described herein onto a substrate using a liquid electrophotographic printer.

Additionally the present disclosure provides a printed article printed by the method described herein using the liquid electrophotographic composition described herein.

The present compositions and methods allow for an inline determination and calibration of a printed transparent, colourless or non-pigmented liquid electrophotographic composition based on the fluorescence profile of the optical brightening agent.

Figure 1:
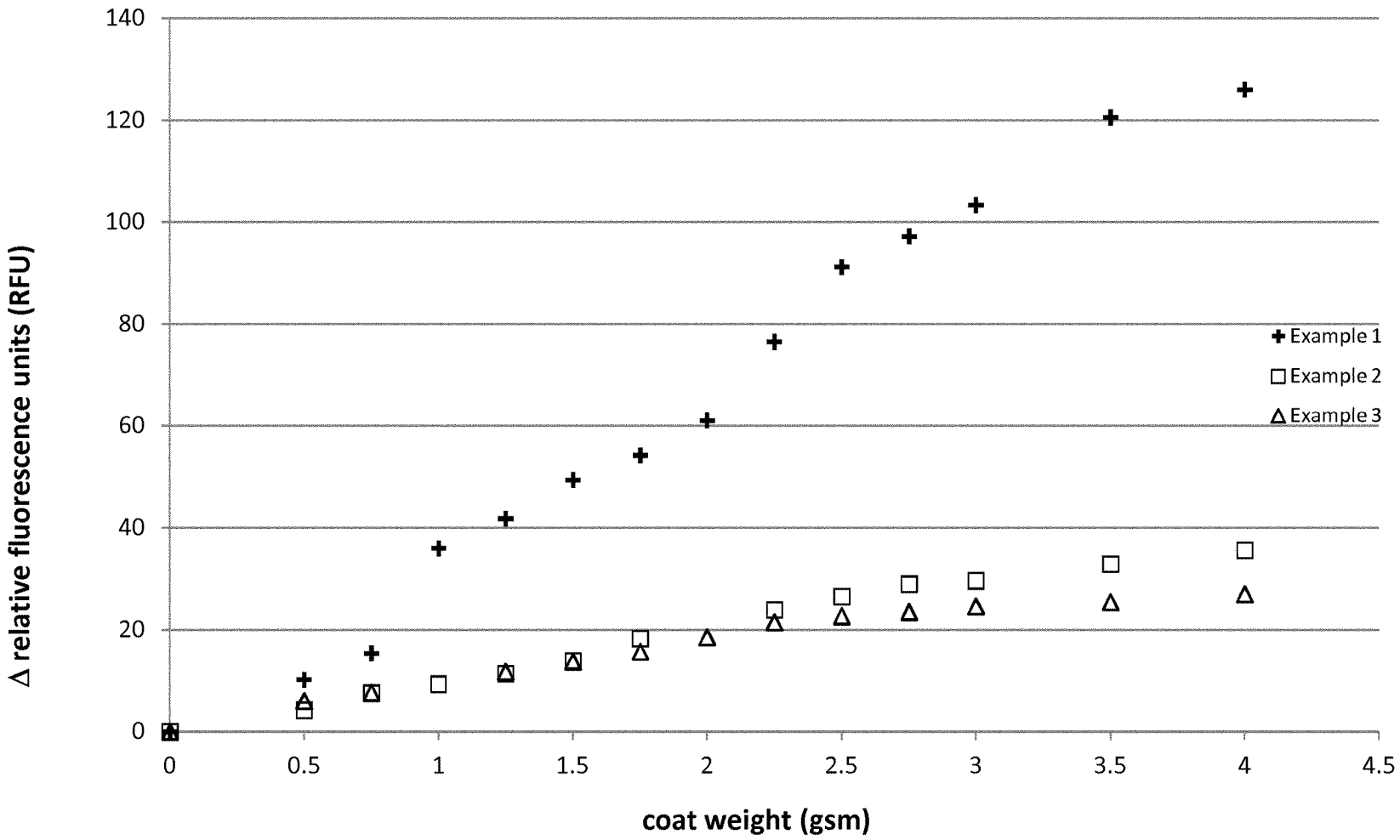
FIG. 1 shows the correlation between the coat weight of a printed transparent or colourless electrophotographic composition of the present disclosure and measured fluorescence.

Described herein are compositions useful in electrophotographic printing methods and which may provide a glossy finish to a printed article. The compositions may also provide a matte finish to an article, or form a protective layer over a printed image.

The liquid electrophotographic compositions described herein comprise a carrier liquid. The optical brightening agent may be substantially insoluble in the carrier liquid. The optical brightening agent may be completely insoluble in the carrier liquid. Generally, the carrier liquid comprises substituted or unsubstituted, linear or branched, aliphatic compounds. The carrier liquid may include aryl substituents. In one example, the carrier liquid can be substantially nonaqueous, i.e. containing less than 0.5% water. In another example, the carrier liquid can be nonaqueous. The carrier liquid can comprise a member selected from the group of paraffins, isoparaffins, oils, alkanes having from about 6 to about 100 carbon atoms, and mixtures thereof. As such, the carrier liquid can comprise, or substantially comprise, or even consist essentially of isoparaffins, such as or equivalent to the ISOPAR® high-purity isoparaffinic solvents with narrow boiling ranges marketed by Exxon Mobil Corporation (Fairfax, Va., USA).

The liquid electrophotographic composition may comprise a cosolvent, such as one or more alkanes having from about 6 to about 14 carbon atoms, for example solvents sold under the NORPAR® (NORPAR® 12, 13 and 15) tradename available from Exxon Mobil Corporation (Fairfax, Va., USA). Other hydrocarbons for use as a carrier liquid, or cosolvent, are sold under the AMSCO® (AMSCO® 460 and OMS) tradename available from American Mineral Spirits Company (New York, N.Y., USA), under the SOLTROL® tradename available from Chevron Phillips Chemical Company LLC (The Woodlands, Tex., USA) and under the SHELLSOL® tradename available from Shell Chemicals Limited (London, UK). Such a carrier liquid, or cosolvent, can have desirable properties such as low odor, lack of color, selective solvency, good oxidation stability, low electrical conductivity, low skin irritation, low surface tension, superior spreadability, narrow boiling point range, non-corrosive to metals, low freeze point, high electrical resistivity, low surface tension, low latent heat of vaporization and low photochemical reactivity.

The liquid electrophotographic compositions described herein include a resin. The resin can be polymerized from monomers selected from the group of ethylene acrylic acid, ethylene methacrylic acid, ethylene acrylic ester maleic anhydride, ethylene acrylic ester glycidyl methacrylate, maleic anhydride, styrene maleic anhydride, and mixtures thereof.

The polymer resin can be selected from resins such as ethylene-vinyl acetate (EVA) copolymers; copolymers of ethylene and an ethylenically unsaturated acid of either acrylic acid and methacrylic acid; copolymers of ethylene, acrylic or methacrylic acid/alkyl ester of methacrylic or acrylic acid; polyethylene; polystyrene; crystalline polypropylene; ethylene ethyl acrylate; ethylene methacrylic acid copolymers which are partially neutralized with metal ions (e.g. Zn, Na, Li) such as SURLYN® ionomers; acid modified ethylene vinyl acetate terpolymer or blends thereof; polyesters; polyvinyl toluene; polyamides; styrene/butadiene copolymers; combinations thereof; and blends thereof. The polymer resin may be a copolymer of ethylene and an ethylenically unsaturated acid of either acrylic or methacrylic acid; an ionomer of ethylene methacrylic acid copolymer; an ester of ethylene methacrylic acid copolymer and an acid modified ethylene vinyl acetate terpolymer; combinations thereof; and/or blends thereof. The polymer resin may be a NUCREL® polymer, such as NUCREL® 925, NUCREL® 2906, NUCREL® 2806, NUCREL® 960, NUCREL® 699 or NUCREL® 599.

The polymer resin may include polymers such as polyamines and polyamides. The resin may be a homopolymer or a copolymer of polyvinyl pyrrolidone. The resin may be a copolymer of polyvinyl pyrrolidone. Examples of monomers polymerized with vinyl pyrrolidone in order to form polyvinyl pyrrolidone copolymers include, but are not limited to, alkylmethacrylates-acrylates such as butylmethacrylates, methylmethacrylates and the like. Illustrative examples of polyvinyl pyrrolidones polymers include, for example, styrene/butylmethacrylate/vinyl pyrrolidone terpolymers, vinyl pyrrolidone/vinyl acetate copolymers, vinyl pyrrolidone homopolymers, and the like. The resin may be a vinyl pyrrolidone/triacontene copolymer (a copolymer of vinylpyrrolidone grafted with triacontene). The resin may be 2-pyrrolidinone 1-ethenyl triacontene polymer.

The resin may be a polyvinyl pyridine polymer or copolymer such as polyvinyl pyridine co-styrene or polyvinyl pyridine co-butyl methacrylate. The resin may be an amino terminated polyacrylate such as poly(t-butyl amino ethyl methacrylate) or poly(dimethyl amino ethyl methacrylate). The resin may be a polymer or copolymer selected from the group consisting of polyethylene imine; polyethylene oxide diamine terminated; polypropylene oxide, monoamine or di-amine terminated; polyamide; polydimethyl siloxane diamino propyl terminated; ethylene/butylene copolymer mono and dihydroxy terminated; hydroxyl ethyl cellulose.

Exemplary embodiments of the resin of the present disclosure include Antaron® WP-660 wax resin, a copolymer available from International Specialty Products and Alcyn® 575 wax resin, a copolymer available from Honeywell Inc.

The resin can encapsulate the optical brightening agent during grinding or mixing to create a fluorescent particle. The fluorescent particle can have a final particle size from about 1 micron to about 10 microns.

In some examples, the resin may represent from about 1 to about 99 weight percent (wt %) of the total amount of solids present in the composition, i.e. wt % of total weight of non volatile substances (NVS). In some other examples, resin may represent from about 25 to about 80 wt % of the total amount of solids present in the ink composition. In yet some other examples, resin may represent from about 35 to about 70 wt % of the total amount of solids present in the ink composition.

The liquid electrophotographic composition includes an optical brightening agent (OBA). Optical brightening agents are typically used to improve whiteness and/or brightness of a media. An OBA absorbs ultraviolet light and re-emits blue light and so is a fluorescent compound. The blue light is added to the reflected light of the media. The media appears less green and/or yellow because more blue light is reflected.

An OBA is also commonly referred to as a fluorescence whitening agent (FWA). It has been recognised that inclusion of an optical brightening agent into a transparent or non-pigmented liquid electrophotographic composition allows an inline determination of the coat weight or thickness of the printed composition based on the fluorescence profile of the optical brightening agent. References in this disclosure to the fluorescence profile of the optical brightening agent are to the difference between the fluorescence emission of the unprinted substrate and the fluorescence of a liquid electrophotographic composition as described herein printed on the substrate.

Basic classes of OBA that can be used in the composition of the present disclosure include triazine-stilbenes, coumarins, imidazolines, diazololes, triazoles, benzoxazolines, and biphenyl-stilbenes. Different OBAs are commercially available from a number of sources, including BASF Corporation Clariant Corporation, and the like. Tinopal® SFP is the trade name of an OBA commercially available from BASF Corporation. Leucophor® NS is the trade name of an anionic OBA commercially available from Clariant Corporation. Other examples of OBAs include Megawhite DT, Megawhite 2B, Megawhite WHN, Megawhite DMX (from Meghmani Dyes and Intermediates Ltd, India).

The OBA is present in the liquid electrophotographic composition in an amount sufficient to allow determination of a fluorescence profile. The OBA may be present in the liquid electrophotographic composition from 0.1% wt. to 2.0% wt based on the total solids content of the composition. In another example, the OBA can be present in the liquid electrophotographic composition from 0.1% wt. to 1.5% wt based on the total solids content of the composition. Further, the OBA can be present in the liquid electrophotographic composition from 0.3% wt. to 1.0% wt based on the total solids content of the composition.

In another example, the OBA can be present in the liquid electrophotographic composition in an amount less than 5.0 wt % based on the total solids of the composition. In another example, the OBA can be present in the liquid electrophotographic composition in an amount less than 2.0 wt % based on the total solids of the composition. In another example, the OBA can be present in the liquid electrophotographic composition in an amount less than 1.8 wt % based on the total solids of the composition. In another example, the OBA can be present in the liquid electrophotographic composition in an amount less than 1.7 wt % based on the total solids of the composition. In another example, the OBA can be present in the liquid electrophotographic composition in an amount less than 1.6 wt % based on the total solids of the composition. In another example, the OBA can be present in the liquid electrophotographic composition in an amount less than 1.5 wt % based on the total solids of the composition.

The liquid electrophotographic composition may contain a charge director. The charge director can be added to the carrier liquid in order to maintain sufficient electrostatic charge on the optical brightening agent particles. For example, the charge components can be nanoparticles of a simple salt and a sulfosuccinate salt of the general formula $MA_n$, wherein M is a metal, n is the valence of M, and A is an ion of the general formula $[R_1—O—C(O)CH_2CH(SO_3)C(O)—O—R_2]$ where each of $R_1$ and $R_2$ is an alkyl group, or other charge component as found in WO 2007/130069. Additionally, charge director compounds include ionic compounds, particularly metal salts of fatty acids, metal salts of sulfo-succinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc. The charge director used herein can be any as known in the art such as described in U.S. Pat. No. 5,346,796.

The charge director may be present in an amount representing from about 0.001 to about 5 weight percent (wt %) of the total amount of solids present in the composition, i.e. wt % of total weight of non volatile substances (NVS). The charge director may be present in an amount representing from about 0.01 to about 0.5 wt % of the total amount of solids present in the composition.

The liquid electrophotographic composition may include a charge adjuvant. The charge adjuvant may include, but is not limited to, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Zn salts of stearic acid, Cu salts of stearic acid, Pb salts of stearic acid, Fe salts of stearic acid, metal carboxylates (e.g., Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock copolymers of 2-ethylhexyl methacrylate-co-methacrylic acid calcium and ammonium salts, copolymers of an alkyl acrylamidoglycolate alkyl ether (e.g., methyl acrylamidoglycolate methyl ether-co-vinyl acetate), and hydroxy bis(3,5-di-tert-butyl salicylic)aluminate monohydrate. The charge adjuvant may be aluminum stearate or aluminum tristearate. The charge adjuvant may be present in an amount of about 0.1 to 5, about 0.5 to 4, and about 1 to 3% weight of the liquid electrophotographic composition.

The liquid electrophotographic composition may also contain a fluorescence adjuvant. The fluorescence adjuvant increases the visible blue light emissions significantly and so enhances the fluorescence profile of the optical brightening agent in the liquid electrophotographic composition. The fluorescence adjuvant may be an organic polyol. Examples of suitable polyols include high molecular weight polyethylene glycol or polyvinyl alcohol. Another example of an organic polyol which can be used as a fluorescence adjuvant is maltose monohydrate.

The liquid electrophotographic composition may also contain others additives such as a surface modifier, compatibility additives, a viscosity control agent, media additives, fixing additives and other additives. A viscosity control agent assists in maintaining viscosity of starting materials combined in a resin grinding and optical brightening agent dispersion process to adequately reduce particle size. During the processing, depending on physical properties of the resin and optical brightening agent and the operating conditions for grinding, optical brightening agent may become encapsulated by resin when loading it on the resin, though encapsulation is not required. A viscosity control agent may be selected that, after grinding, also functions as a charge adjuvant.

The liquid electrophotographic compositions of the present disclosure can also be suitable for use on many types of substrates of recording media, including but not limited to vinyl media, cellulose-based paper media, various cloth materials, polymeric materials (non-limitative examples of which include polyester white film or polyester transparent film), photopaper (non-limiting examples of which include polyethylene or polypropylene extruded on one or both sides of paper), metals, and/or mixtures or composites thereof.

In another example, a method of manufacturing a liquid electrophotographic composition can comprise grinding a carrier liquid, a polymer resin and an optical brightening agent to form the liquid electrophotographic composition.

In the present method, the grinding can be performed from 1 hour to 30 hours. In one example, the grinding can be performed less than 30 hours. In one example the grinding can be performed for about 24 hours. Additionally, the grinding can be performed at less than 1000 rpm. The grinding can also be performed at a temperature from 20° C. to 60° C. In one example, the temperature can be from 25° C. to 50° C. In one example, the temperature can be about 25° C.

In one example of the present method, the carrier liquid and the polymer resin may be in the form of an off-the-shelf or prior-prepared electrophotographic paste composition, to which the optical brightening agent is added. For example, the method of manufacturing a liquid electrophotographic composition may comprise grinding an optical brightening agent with an electrophotographic paste composition, the electrophotographic paste composition comprising a carrier liquid and a polymer resin. The prior-prepared electrophotographic paste composition may comprise additives such as charge directors, charge adjuvants and viscosity modifiers as hereinbefore described. The method may comprise grinding a carrier liquid, a polymer resin, a charge adjuvant and an optical brightening agent to form the liquid electrophotographic composition.

In another example, a method of electrophotographic printing can comprise printing the liquid electrophotographic composition described herein onto a substrate using a liquid electrophotographic printer.

The substrate or receiver media can be of any size. The substrate (or media substrate) includes any substrate that can be used in the electrophotographic printing arts, including paper, resin coated paper, overhead projector plastics, fabrics, art papers and the like.

In a further example, a printed article is printed by the method described herein using the liquid electrophotographic composition described herein.

EXAMPLES

The following examples are to be understood as being only exemplary or illustrative of the application of the principles of the present invention. Numerous modifications and alternative compositions and methods may be devised by those skilled in the art without departing from the spirit and scope of the present invention. Thus, these examples should not be considered as limitations of the present disclosure, but are merely in place to teach how to make compositions of the present disclosure.

Many printing papers contain brightening agents. In order to minimise fluorescence from the tested substrate and to demonstrate the correlation between fluorescence of the printed film (comprising the optical brightening agent) and the coat weight or thickness of the film, the liquid electrophotographic compositions of the present disclosure were printed onto a substrate which had been pre-printed with four layers of a cyan liquid electrophotographic ink.

Example 1

92 grams of E.I 4.5 paste (Nucrel 699 and A-C 5120 resins in a ratio of 4:1; swollen with Isopar; 25% solids), 16 gr. fluorescence adjuvant (maltose monohydrate (from Sigma Aldrich)), 1.8 gr. charge adjuvant (aluminum stearate; from Sigma Aldrich), and 0.4 gram of optical brightening agent (Megawhite DT from Meghmani Dyes and Intermediates Ltd. India) were grinded for 24 h at 25° C. using S0 attritor from Union Process (USA).

The electrographic composition was applied onto a substrate at various controlled coat weights by using the following method:

A liquid composition of about 2% solids was prepared using the OBA-containing paste prepared above and an isoparaffinic based carrier liquid (Isopar) and its solid content determined accurately. The latter is referred to as the stock solution. In this example the solid content of the stock solution was 2.1%. For each coat weight 15 g of test composition with the appropriate solid content was prepared by dilution of the above stock solution using Isopar.

The amount of the stock solution to be diluted with Isopar to obtain 15 g of test solution was determined according to the following calculation:

| | |
|---|---|
| Mass of stock solution to be diluted by Isobar to a mass of 15 g [g] | W |
| Total mass of test composition [g] | 15 |
| Density of the composition [g/cm$^3$] | 0.76 |
| Desired coat weight [g/m$^2$] | CW |
| Stock solution concentration w/w [%] | M |

$$W=CW*15/(0.76*10*M) \quad \text{Eq. 1}$$

Each of the diluted compositions was charged by up to 8 drops of charge director in the form of 0.1% Imaging Agent from HP prior to plating.

Each test composition was plated onto a substrate using a plating cell containing a fixed volume of the tested composition. A Condat paper substrate which had been pre-printed with a cyan liquid electrophotographic ink was placed on the positive electrode. The composition was plated on a predetermined known area on the paper substrate by applying 1500 V for 8 seconds. The substrate was placed perpendicular to a table surface for drainage of the excess of Isopar. The back of the paper was passed back and forth on a hot surface at 130° C. for 30 sec for complete drying of the composition layer on top of the paper substrate. The coat weight applied was controlled by changing the solid content of the composition.

Figure 2:
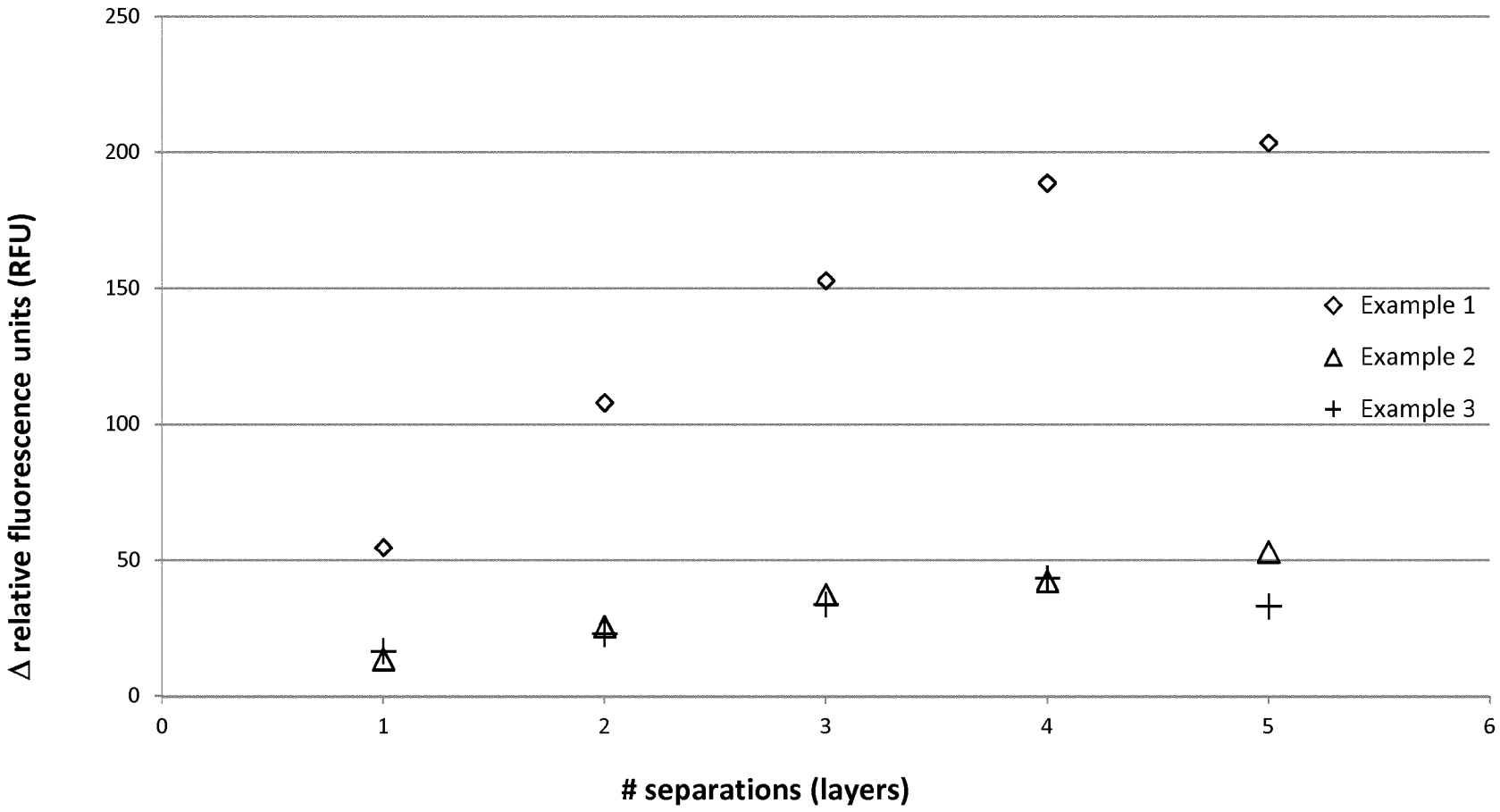
FIG. 2 shows the correlation between the number of printed layers of a transparent or colourless electrophotographic composition of the present disclosure and the measured fluorescence.

After drying the fluorescence was determined for each coat weight (as shown in FIG. 1 and Table 1) using a PerkinElmer LS45 luminescence spectrometer, with a excitation wavelength of 356 nm and fluorescence measured at 470 nm. Correlation between fluorescence and the numbers of printed layers of this transparent composition is shown in FIG. 2 and Table 2.

Example 2

87.11 grams of resin paste (Nucrell 925, Nucrell 2806 and Bynel 2022 in the weight proportions 72:18:10; 45% solids), 0.4 gram of Megawhite DT (from Meghmani Dyes and Intermediates Ltd. India) 0.4 gr. aluminum stearate, were grinded for 24 h at 25° C. using S0 attritor from Union Process (USA) before being diluted with Isopar to 1.79% solids based on moisture content as determined using Sartorius model MA150, as described above. The resulting composition is stock solution #2.

Various desired coat weights are obtained by dilution of the above stock solution #2 to various concentrations of solids as described in Example 1 and printing of test solutions as also described in Example 1. The fluorescence was determined for each coat weight as shown in FIG. 1 and Table 1. Correlation between fluorescence and the numbers of printed layers of this transparent composition is shown in FIG. 2 and Table 2.

Example 3

158.4 grams of transparent Electroink from HP Indigo (HP Indigo Electroink Transparent; 25% solids), 0.4 gram of Megawhite DT (from Meghmani Dyes and Intermediates Ltd. India) were grinded for 24 h at 25° C. using S0 attritor from Union Process (USA). The transparent ink was diluted to 1.96% solids using Isopar as determined using Sartorius model MA150, as described above to form stock solution #3.

Various desired coat weights are obtained by dilution of the above stock solution to various concentrations of solids as described in Example 1. The fluorescence was determined for each coat weight as shown in FIG. 1 and Table 1. Correlation between fluorescence and the numbers of printed layers of this transparent composition is shown in FIG. 2 and Table 2.

As can be seen in FIG. 1, there is a direct correlation in all three Examples between coat weight (containing a predetermined amount of optical brightening agent) and fluorescence profile of the tested composition. Furthermore, it can be seen that inclusion of a fluorescence adjuvant (Example 1, in the form of maltose monohydrate) leads to an enhancement of the fluorescence of the tested composition. However, and as is clear from Examples 2 and 3, a linear relationship between coat weight and fluorescence in the absence of this fluorescence adjuvant can still be established.

TABLE 1

| | Fluorescence Measurements | | | | | | | | |
|---|---|---|---|---|---|---|---|---|---|
| | Example 1 | | | Example 2 | | | Example 3 | | |
| gr per m$^2$ | Δ fluorescence (AV.) n = 30 | STDV | CV (%) | Δ fluorescence (AV.) n = 30 | STDV | CV(%) | Δ fluorescence (AV.) n = 30 | STDV | CV (%) |
| 0.5 | 10.2 | 0.31 | 3 | 4.21 | 1.13 | 11.9 | 5.99 | 0.77 | 6.9 |
| 0.75 | 15.41 | 0.17 | 1.1 | 7.54 | 0.76 | 5.9 | 7.66 | 0.55 | 4.2 |
| 1 | 36.01 | 0.36 | 1 | 9.31 | 0.45 | 3.1 | 11.12 | 0.49 | 3 |
| 1.25 | 41.82 | 0.88 | 2.1 | 11.36 | 0.57 | 3.4 | 11.74 | 0.67 | 3.9 |
| 1.5 | 49.39 | 4 | 8.1 | 13.92 | 1.55 | 8.1 | 13.76 | 1.89 | 9.9 |

TABLE 1-continued

| Fluorescence Measurements | | | | | | | | | |
|---|---|---|---|---|---|---|---|---|---|
| | Example 1 | | | Example 2 | | | Example 3 | | |
| gr per $m^2$ | Δ fluorescence (AV.) n = 30 | STDV | CV (%) | Δ fluorescence (AV.) n = 30 | STDV | CV(%) | Δ fluorescence (AV.) n = 30 | STDV | CV (%) |
| 1.75 | 54.22 | 1.78 | 3.3 | 18.31 | 0.71 | 3 | 15.72 | 1.09 | 5.2 |
| 2 | 61.07 | 1.21 | 2 | 24.42 | 0.49 | 1.7 | 18.62 | 0.21 | 0.9 |
| 2.25 | 76.55 | 10.3 | 13.5 | 23.93 | 0.81 | 2.8 | 21.52 | 0.41 | 1.5 |
| 2.5 | 91.22 | 2.82 | 3.1 | 26.57 | 0.08 | 0.3 | 22.71 | 0.42 | 1.5 |
| 2.75 | 97.2 | 6.27 | 6.5 | 29 | 1.29 | 3.8 | 23.54 | 2.86 | 9.9 |
| 3 | 103.33 | 1.93 | 1.9 | 29.64 | 1.29 | 3.7 | 24.64 | 0.06 | 1.8 |
| 3.5 | 120.61 | 3.1 | 2 | 32.94 | 0.47 | 1.2 | 25.44 | 0.71 | 2.4 |
| 4 | 126.06 | 7.66 | 6 | 35.58 | 0.9 | 2.2 | 27.02 | 1.24 | 3.9 |

TABLE 2

| Number of printed layers vs. fluorescence of transparent inks | | | |
|---|---|---|---|
| Layer # | Example 1 | Example 2 | Example 3 |
| 1 | 54.74 | 13.59 | 16.7 |
| 2 | 108.03 | 25.6 | 22.94 |
| 3 | 152.85 | 37.32 | 33.85 |
| 4 | 188.8 | 42.36 | 43.39 |
| 5 | 203.5 | 53.15 | 33.09 |

While the invention has been described with reference to certain embodiments, those skilled in the art will appreciate that various modifications, changes, omissions, and substitutions can be made without departing from the spirit of the disclosure. It is intended, therefore, that the invention be limited only by the scope of the following claims. The features of any dependent claim can be combined with the features of any of the other dependent claims, and any independent claim.

The invention claimed is:

1. A liquid electrophotographic composition, comprising:
a carrier liquid;
a polymer resin;
an optical brightening agent; and
a fluorescence adjuvant, the fluorescence adjuvant being maltose monohydrate;
wherein the liquid electrophotographic composition is colorless.

2. The liquid electrophotographic composition of claim 1, wherein the liquid electrophotographic composition is a non-pigmented electrophotographic composition.

3. The liquid electrophotographic composition of claim 1, wherein the optical brightening agent is a non-pigmented optical brightening agent.

4. The liquid electrophotographic composition of claim 3, wherein the optical brightening agent is a fluorophore.

5. The liquid electrophotographic composition of claim 1, wherein the optical brightening agent is present in a predetermined amount.

6. The liquid electrophotographic composition of claim 1, wherein the optical brightening agent is present in an amount of less than 5.0 wt % based on the total solids content of the composition.

7. The liquid electrophotographic composition of claim 6, wherein the optical brightening agent is present in an amount of less than 2.0 wt % based on the total solids content of the composition.

8. The liquid electrophotographic composition of claim 1, wherein the optical brightening agent comprises one or more of a triazine stilbene and derivatives thereof, a biphenyl stilbene and derivatives thereof, a coumarin and derivatives thereof, a benzoxazoline and derivatives thereof, a diazolole and derivatives thereof, an imidazoline and derivatives thereof, or mixtures thereof.

9. The liquid electrophotographic composition of claim 1, wherein the composition further comprises a charge director.

10. The liquid electrophotographic composition of claim 1, wherein the optical brightening agent is insoluble in the carrier liquid.

11. A method of manufacturing the liquid electrophotographic composition of claim 1, comprising grinding the carrier liquid, the polymer resin, the optical brightening agent, and the fluorescence adjuvant to form the liquid electrophotographic composition.

12. The method of claim 11, wherein the carrier liquid and polymer resin are combined to form an electrophotographic paste prior to grinding with the optical brightening agent and the fluorescence adjuvant.

13. A method of electrophotographic printing, comprising printing the liquid electrophotographic composition of claim 1 onto a substrate using a liquid electrophotographic printer.

14. A printed article, printed by the method of claim 13.

15. The method of claim 12, wherein the electrophotographic paste consists of the carrier liquid and the polymer resin.

* * * * *